United States Patent [19]

Finkelstein

[11] Patent Number: 4,891,854

[45] Date of Patent: Jan. 9, 1990

[54] FACE AND HEAD SUPPORT ASSEMBLY FOR USE WITH A LOUNGE CHAIR OR LIKE STRUCTURE

[76] Inventor: Neal B. Finkelstein, 8565 S.W. 137 Ave., Miami, Fla. 33183

[21] Appl. No.: 335,754

[22] Filed: Apr. 10, 1989

[51] Int. Cl.[4] ..... A47C 20/02; A47C 17/66

[52] U.S. Cl. ..... 5/435; 5/111; 297/452

[58] Field of Search ..... 5/435, 431, 434, 436, 5/437, 110, 114; 297/452, 191, 217

[56] References Cited

U.S. PATENT DOCUMENTS

| | | | |
|---|---|---|---|
| 2,551,727 | 5/1951 | Costello | 5/435 |
| 3,114,527 | 12/1963 | Demarest | 5/435 |
| 3,897,102 | 7/1975 | Lemaire | 5/111 |
| 4,535,878 | 8/1985 | Grahl | 5/435 |
| 4,606,086 | 8/1986 | Rowland | 5/431 |

FOREIGN PATENT DOCUMENTS

| | | | |
|---|---|---|---|
| 2501986 | 9/1982 | France | 5/110 |

*Primary Examiner*—Alexander Grosz

*Attorney, Agent, or Firm*—Malloy & Malloy

[57] ABSTRACT

A support assembly designed to be mounted on or used directly in combination with a lounge chair or like structure to facilitate the face-down reclining of a person on the lounge chair in order to expose his back to the sun's rays without hypertension of the neck. The support assembly includes a base extending transversely across preferably a backrest portion of the lounge chair and has an opening formed therein having a specifically structured periphery which confronts the face of the user in a manner which allows a major portion of the surface of the face including the nose, mouth, etc. to pass therethrough.

2 Claims, 2 Drawing Sheets

FIG. 1
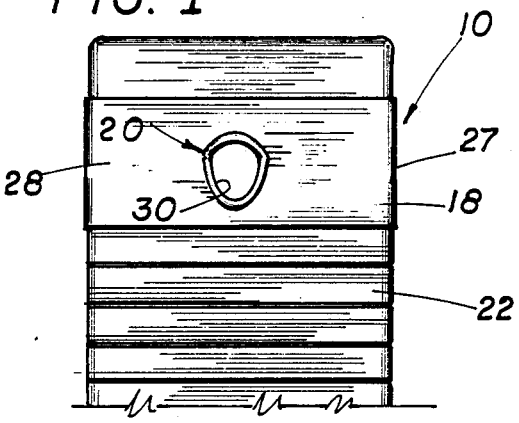
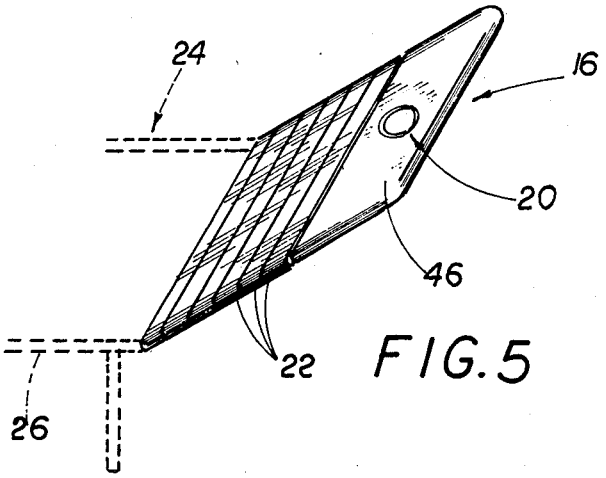
FIG. 5
FIG. 2
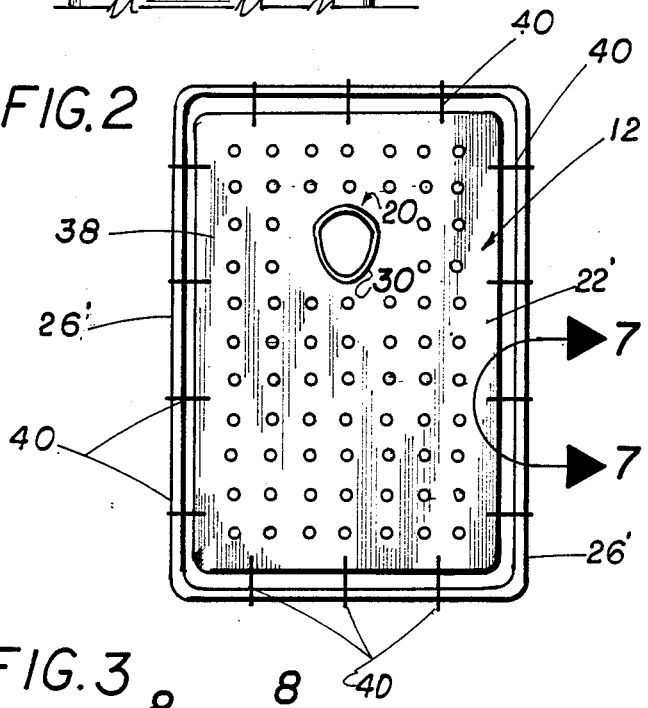
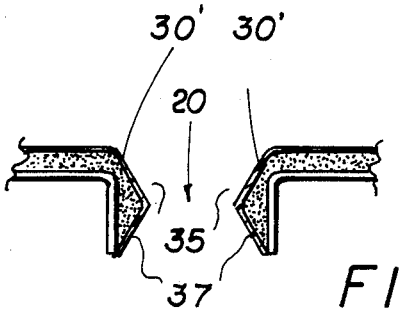
FIG. 8
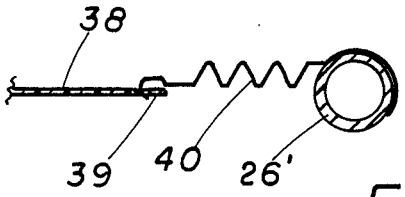
FIG. 7
FIG. 3
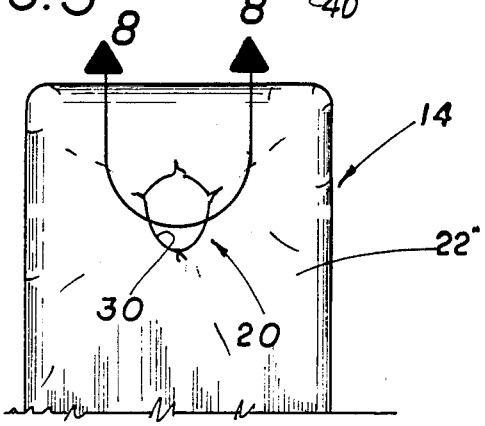
FIG. 4
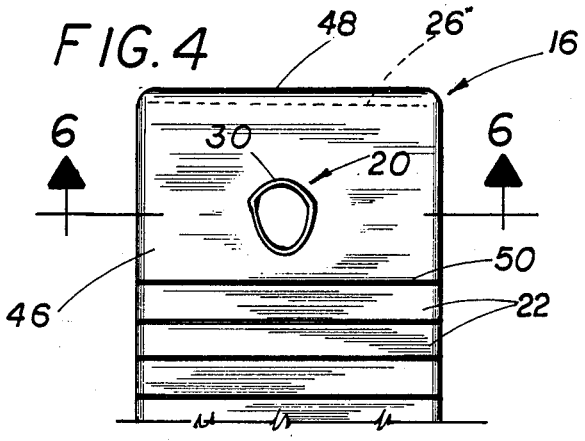

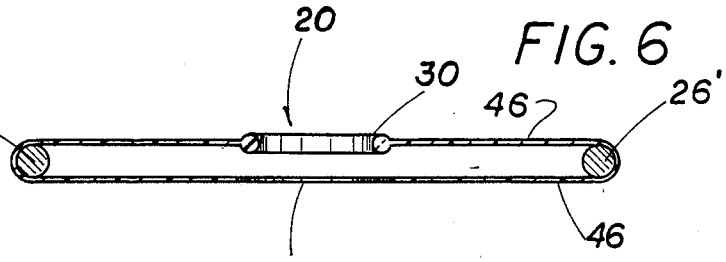
FIG. 6
FIG. 12
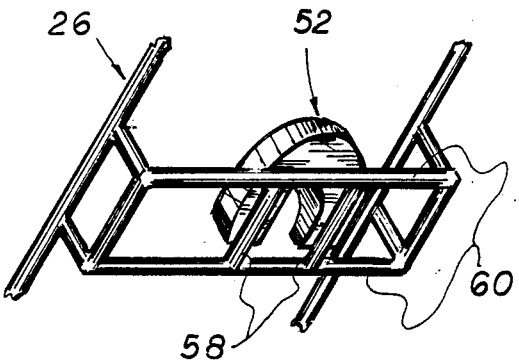
FIG. 10
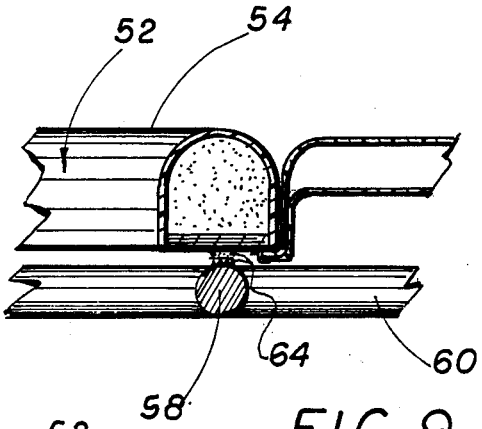
FIG. 9
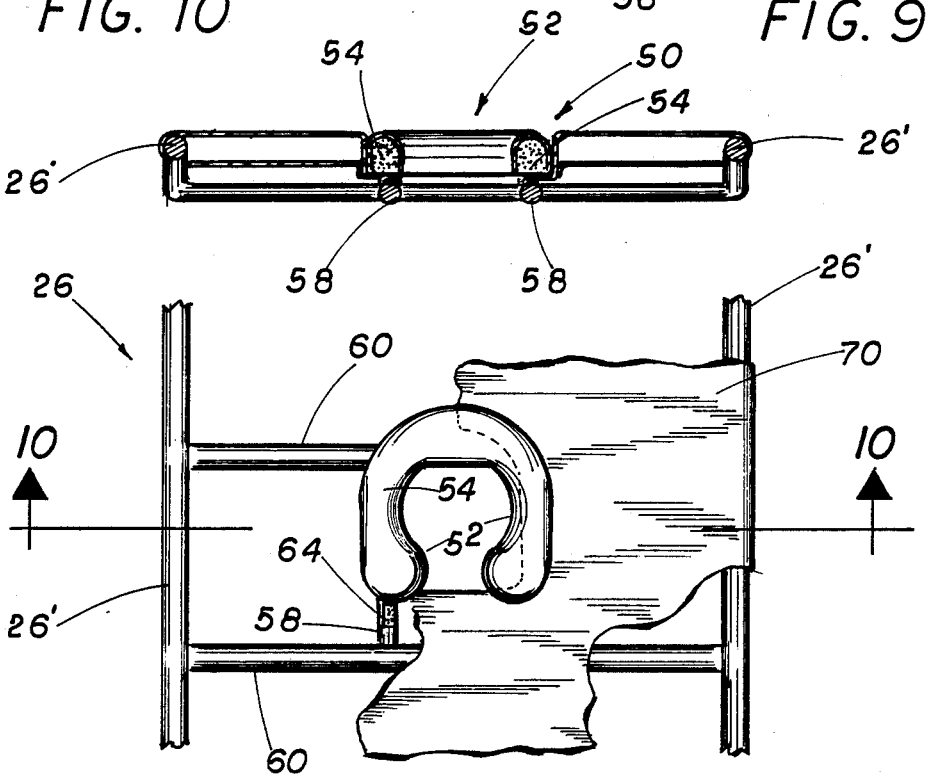
FIG. 11

FACE AND HEAD SUPPORT ASSEMBLY FOR USE WITH A LOUNGE CHAIR OR LIKE STRUCTURE

BACKGROUND OF THE INVENTION

1. Field of the Invention

The present invention is directed towards a support assembly designed to be mounted on a lounge chair or the like to supportingly engage the face of a user such that he may assume a face-down reclined position on the lounge chair while allowing the face, including the mouth, nose, eyes, etc., to be substantially unobstructed such as when the user is taking a sunbath or the like without hypertension of the neck.

2. Description of the Prior Art

Sunbathing has been a popular form of recreation for many years. Typically, sunbathing comprises one positioning himself in a reclined position both on his back and front side particularly when it is desirous to allow the sun's rays to be exposed to nearly all portions of the body. Certain difficulties or disadvantages are normally encountered when the sunbather wishes to "tan" his backside. Such difficulties are generally associated with the structure of a lounge chair or the like when such is used and involves the general discomfort associated with such a position. Whether the sunbather is supported on a beach towel on the ground or on a lounge chair, there is a problem with the location of the face and head in a desired normal position, comfortable orientation which does not obstruct the breathing of the sunbather. The general, recognized structure of a lounge chair is such that the head cannot be properly oriented in a comfortable position for a prolonged period of time without obstructing the breathing passages or otherwise putting undue pressure on the neck area so as to render the sunbather uncomfortable.

The prior art recognizes problems as set forth above as evidenced in the following U.S. patents.

Backhouse, U.S. No. 2,717,399 discloses an underwater viewing device which, while not specifically directed to a sunbather, does show the ability of a user of the Backhouse device to be supported on a raft in a face-down position and provide a general support area as well as a combined viewing area for the face. This does not address the specific structural problem in lounge chairs, especially relating to the pressure on the neck.

The patent to Grahl, U.S. No. 4,535,878 discloses a pillow-tote bag device for use with a lounge chair or like supporting structure as disclosed in FIGS. 4 and 5 thereof. The device of Grahl provides for an opening by a separation in the structure for the placement of the facial portion of the user when in a face-down, reclined position on a lounge chair or like support structure.

The patent to Jones, U.S. No. 2,239,003 discloses a headrest which is constructed to afford the maximum degree of comfort and ease in supporting the head while a person is resting upon the stomach and supporting the head at the proper height while the body rests upon pillows or other support. The headrest structure of Jones is not specifically adaptable or intended for use in combination with a lounge chair structure or particularly when the user thereof is sunbathing.

Accordingly, in view of the prior art attempts as set forth above, there is still a need for a support assembly designed to facilitate the "face-down" support and inclination of a user, when sunbathing, which will support the head and face area but not obstruct the breathing passages and which will make the user much more comfortable when maintaining such position for prolonged periods. Also, there is a need for a structure, which allows a normal posture without undue strain on the muscles, joints and bones of the neck.

SUMMARY OF THE INVENTION

The present invention is directed to a support assembly designed to be removably attached to or mounted in permanent fashion on a lounge chair or like structure and used in combination therewith so as to comfortably and efficiently support a person's body when in a "face-down" reclining position such as when sunbathing. This structure could be a permanent fixture for future productivity of lounge chairs to permit better posture alignment for the user. More specifically, the support assembly of the present invention includes a base generally formed of a flexible material and attached to the frame of the lounge chair or like supporting structure in a somewhat transverse orientation to the position of a user's body when reclining thereon. More specifically, the base of the subject support assembly is mounted generally along an upper end of the backrest in substantial registry with the head when the user of the lounge chair assumes a normal reclining or angular position.

Naturally, when the user intends to recline in a substantially face-down position, the backrest and remainder of the lounge chair are substantially aligned in a somewhat horizontal orientation. In order to facilitate comfort and breathing, etc. of the user when in the aforementioned face-down position, the base includes an opening integrally formed therein. The opening is further structured to include a substantially continuous periphery formed of a somewhat cushioning or soft, flexible material in order to add comfort to the confronting engagement between the periphery of the opening and the face of the user. In addition, the opening is generally large enough so that the eyes, nose and mouth pass therethrough substantially out of confronting engagement with the surrounding periphery of the opening. Accordingly, both comfort and breathing, viewing, talking, etc. of the user is facilitated even when he maintains the face-down position for prolonged periods. This face-down position is of course assumed so that the back skin surface area is exposed to the rays of the sun for tanning or the like.

Dependent upon the embodiment of the subject support assembly utilized, the base may be attached at each of its opposite ends to correspondingly disposed portions of the frame of the lounge chair. Alternately, the base may be permanently attached to the lounge chair.

Yet another embodiment would include the base being structure in the form of a sleeve-like structure having one closed end and one open end. In the sleeve-like embodiment, the base effectively slides or telescopes over the upper or outer end of the backrest. The base and aperture are respectively disposed and dimensioned to pass down a sufficient distance over the outer, free end of the backrest to a point where the aperture is in registry with the face of the user when the user is in the aforementioned face-down, reclined position.

Yet another embodiment of the present invention contemplates that the base be removably attached to the lounge chair and portable to the extent that it is carried or transported with the user and adapted to be appropriately mounted on any number of lounge chairs dependent upon their various design characteristics.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

FIG. 1 is a front plan view in partial cutaway of the support assembly the present invention.

FIG. 2 is a front plan view of another embodiment of the present invention.

FIG. 3 a front plan view in partial cutaway of yet another embodiment of the present invention.

FIG. 4 is a front plan view in partial cutaway of another embodiment of the present invention.

FIG. 5 is a perspective view of the embodiment of FIG. 4.

FIG. 6 sectional view along line 6—6 of FIG. 4.

FIG. 7 sectional view in partial cutaway along line 7—7 of FIG. 2.

FIG. 8 a sectional view in partial cutaway along line 8—8 of FIG. 3.

FIG. 9 is a sectional view in partial cutaway of details of the of FIG. 11.

FIG. 10 is a transverse sectional view of the embodiment of FIG. 11 along line 10—10.

FIG. 11 is another embodiment of the present invention shown in partial cutaway and phantom.

FIG. 12 is a perspective view in partial cutaway of the embodiment of FIG. 11.

Like reference numerals refer to like parts throughout the several views of the drawings.

DETAILED DESCRIPTION OF THE PREFERRED EMBODIMENT

As shown in FIGS. 1 through 5, the present invention is directed to a support assembly generally indicated as 10, 12, 14, 16, which includes a base portion serving to attach or mount a receiving opening 20 in registry with the face and/or head of a user disposed in a reclined, overlying position relative to supporting structure 22 of a lounge chair generally indicated as 24 and more particularly a backrest portion thereof. In the embodiment of FIGS. 1, 4 and 5, the supporting portion of the respective lounge chair structure comprises a plurality of vinyl or like flexible material straps extending transversely along appropriately positioned frame portions indicated in phantom lines as 26 for support of the user's body. Naturally, in the conventional fashion the user's body lies generally along the length of the lounge chair structure 24 wherein the backrest may or may not pivot or be angularly adjustable relative to the remainder of the lounge chair.

In the embodiment of FIG. 1, the base 18 comprises a flexible material panel secured at opposite ends 27 and 28 to the frame preferably in a manner which is fixed thereto. Alternately, the flexible material base or panel 18 may be removably attached by any number of conventional structures. In any event, the vinyl straps as at 22 which would normally be positioned where the base 18 is shown in FIG. 1 are either removed or spread apart by appropriately positioned hooks attached to the base generally at opposite ends of the opening 20. Depending upon the embodiment, the opening 20 preferably has a peripheral portion as at 30 formed of a supportive, cushioning material which may be soft, flexible, etc. so as to add comfort to the portions of the face which the periphery 30 confronts.

As shown in FIG. 8, another embodiment of the present invention relating to the overall support assembly 14 as shown in FIG. 3 comprises the opening 20 having a periphery 30' with a downwardly sloping receiving surface designed to confront the facial portion in substantially surrounding relation to the nose, mouth, eyes, etc. In addition, the opening 20 has an under, outwardly slanting surface portion 37 wherein the overall configuration is designed to provide maximum comfort to the user, when the face is placed within the aperture 20 to allow breathing when in a face-down reclining position.

The embodiment of FIG. 2 discloses the backrest portion only wherein the base of the support assembly may be indicated as at 38 and be an integral portion of the support frame defining the backrest portion. The periphery of the backrest portion as well as the base 38 are secured by mounting means including a plurality of spring members 40. As best shown in FIG. 7, the spring members 40 have one end attached to the periphery of the backrest support member also the defining the base 38 as at 39. The opposite end of the spring members 40 are attached to the appropriately positioned frame portion 26'. In the embodiment of FIGS. 4, 5 and 6, the base 46 comprises a transverse sleeve-like member having a closed end 48 and an open end as at 50 wherein the open end serves to slide over the upper free end of the frame as indicated as 26''. Similar to certain embodiments such as that of FIG. 3, the opening 20 is in registry with a fixed integrally formed aperture as at 29 formed in an undersurface portion of the base 46 as best shown in FIG. 6.

With regard to the embodiments of FIGS. 9, 10, 11 and 12, the support assembly 50 includes an aperture 52 surrounded by a cushioned or upwardly raised periphery 54 which confronts the face of the user when in a face-down reclined position. A support or retraining structure as at 58 is integrally or otherwise fixed to the frame and may include as a portion thereof, cross brace bars 60. The undersurface of the periphery rests on and may be fixedly or removably affixed to the confronting surface of the members 58 as best shown in FIGS. 9, 10, 11, and 12. Such confronting attachment may be accomplished by a hook and loop-type fastener as at 64 so as to position the periphery 54 in registry with the general location of the face when the user is in the aforementioned face-down position.

The base portion associated with the periphery 54 may be considered an integral part of the backrest portion as at 70 which effectively underlies the periphery 54 of the opening 52. The base 70 can be attached to the frame 26, 26' either by the sleeve-like configuration similar to that of FIGS. 5 and 6, or the elongated end attachments of the flexible panel 18 as shown in FIG. 1.

Now that the invention has been described,

What is claimed is:

1. A support assembly designed to support a person's head in a reclining, face-down position and mounted on a lounge chair, said assembly comprising:

(a) a base comprising a front portion and a rear portion disposed in spaced relation to one another and defining a hollow interior, said front and rear portions connected by a closed end of said base and including an open end oppositely disposed to said closed end, said open end and hollow interior being dimensioned to slidingly surround an upper free end of a backrest portion of the lounge chair, (b) an opening formed in said base and extending therethrough between opposite sides thereof and dimensioned and configured to allow passage of a major portion of the user's face therethrough, (c) said opening including a peripheral portion disposed substantially continuously along the majority of the length of the peripheral edge thereof and extending outwardly from a surface of said base, (d) said peripheral portion formed of a cushioning material and disposed in supporting, confronting engagement with the surface of the face and dimensioned to surround the mouth, nose and eyes thereof.

2. An assembly as in claim 1 wherein said peripheral portion includes a cushion structure extending inwardly from the periphery of the opening towards a substantial center portion of the opening.

* * * * *